US007303233B2

(12) United States Patent
Kitahata

(10) Patent No.: US 7,303,233 B2
(45) Date of Patent: Dec. 4, 2007

(54) HEIGHT ADJUSTABLE CHAIR WITH ROCKING FUNCTION

(75) Inventor: Yutaka Kitahata, Tokyo (JP)

(73) Assignee: Plus Corporation, Tokyo (JP)

( * ) Notice: Subject to any disclaimer, the term of this patent is extended or adjusted under 35 U.S.C. 154(b) by 0 days.

(21) Appl. No.: 11/438,344

(22) Filed: May 23, 2006

(65) Prior Publication Data

US 2007/0052270 A1 Mar. 8, 2007

(30) Foreign Application Priority Data

May 23, 2005 (JP) ..... 2005-149589
Apr. 6, 2006 (JP) ..... 2006-105746

(51) Int. Cl.
*A47C 7/60* (2006.01)

(52) U.S. Cl. ..... 297/300.8; 297/270.1; 297/301.6

(58) Field of Classification Search ..... 297/270.1, 297/270.2, 270.3, 270.4, 300.8, 301.6, 301.7, 297/300.7
See application file for complete search history.

(56) References Cited

U.S. PATENT DOCUMENTS 4,561,693 A * 12/1985 Brownlie et al. .... 297/300.7 X
6,419,320 B1 * 7/2002 Wang ..... 297/300.8
6,488,336 B1 * 12/2002 Wang ..... 297/301.7

FOREIGN PATENT DOCUMENTS

JP 06-026588 4/1994

* cited by examiner

*Primary Examiner*—Anthony D. Barfield
(74) *Attorney, Agent, or Firm*—Bingham McCutchen LLP

(57) ABSTRACT

The invention provides a chair that the switching between operation and fixation of rocking may be operated with the height adjustment of the chair by one operation lever. A resilient member is interposed between a seat frame whose height is adjustable by a cylinder and a back frame rotatably fitted to the seat frame, wherein a joint member is rotatably fitted to the seat frame with a vertical shaft, an operation lever led to the outside of the seat frame and a pressing piece which touches and leaves a button for rod advancing and retreating of the cylinder are provided with a rocking member which is rockably assembled to the joint member with a horizontal shaft, and an interlocking regulating member is attached to an arm piece of the joint member so that the rotation of the back frame may be adjusted by moving the regulating member.

2 Claims, 11 Drawing Sheets

HEIGHT ADJUSTABLE CHAIR WITH ROCKING FUNCTION

BACKGROUND OF THE INVENTION

1. Field of the Invention

The present invention generally relates to a height adjustable chair with rocking function, which is used as an office chair.

2. Description of Prior Art

A height adjustable chair with rocking function having a means for rocking a back plate (backrest) and a means for adjusting a height of a seat plate has a structure that, for example, as a chair disclosed in Japanese Utility Model Publication 6-26588, adjusts a height of a seat plate, namely adjusts an extension and contraction of a support leg to which a gas spring is internally fitted, by operating a button for advancing and retreating a rod of a gas spring with a pressing part of base end side of an operation lever protruding to the outside of a seat frame to which the seat plate is attached and adjusts, on the other hand, a cushioning property of the back plate (back frame) by adjusting a spring pressure of a rocking compression spring by vertically moving an adjustment plate by operating a knob of an adjustment screw protruded to a lower back side of the seat frame.

SUMMARY OF THE INVENTION

In the above described prior art, an operation portion (knob of the adjustment screw) for adjusting a strength of the compression spring (cushioning property of the back plate) for rocking and an operation portion (operation lever) for operating a button of a gas spring (cylinder) for adjusting the height by lifting and lowering the seat plate are separate parts, therefore each operation portions must be assembled separately at a seat receiving member and the structure thereof could be complicated.

The present invention was made for providing a height adjustable chair with rocking function which an operation portion for adjusting the strength of rocking movement and an operation portion of the cylinder for lifting and lowering the seat plate (extending and contracting a leg support) were constructed as the same operation portion.

In addition, the strength adjustment of rocking movement includes the adjustment of a strength of resilient repulsion of the back plate, the switching between the resiliently support of the back plate and the blocking of the back plate so as to fix the rear reclining thereof, and the adjustment of the reclining range of the back plate which is supported by resilient repulsion and whose rear reclining angle changes.

Namely, the present invention provides a height adjustable chair with rocking function comprising a seat frame which is supported with a leg support extended and contracted by a cylinder internally fitted to, a back frame which is rotatably fitted to the seat frame at the forward end side thereof, and an resilient member for rocking which is interposed between the seat frame and the back frame; wherein a joint part of a joint member having an arm piece protruded on the joint part is rotatably assembled to the seat frame with a vertical shaft; wherein a rocking member whose base part is rockably fitted to the joint part with a horizontal shaft is assembled, wherein an operation lever whose tip is led to the outside of the seat frame is equipped at one end of the rocking member to make the operation lever rotatable in vertical and lateral directions with the vertical and horizontal shaft.

Additionally, a pressing piece which always positions over a button for rod advancing and retreating of the cylinder and touches and leaves thereof is provided at the other end of the rocking member to enable the extension and contraction of the leg support by vertically moving operation of the operation lever, and a regulating member which moves according to the rotation of the tip of the arm piece protruded at the joint part is provided in the seat frame, whereby the regulating member enable to move by the laterally moving operation of the operation lever and the rotation control of the back frame is adjustable by moving the regulating member.

Moreover, the present invention further comprises a compression spring as the resilient member which is interposed between the seat frame and the back frame and an adjustment piece as the regulating member which has a cam part in the middle portion thereof, wherein the adjustment piece is rotatably connected to the tip of the arm piece at the tip thereof with an intermediate piece and is rotatably fitted to the seat frame at the base part thereof to make the cam part provided at the adjustment piece movable by rotating the adjustment piece according to the rotation of the arm piece, and the cam part provided at the middle portion of the adjustment piece has an upper face having a level difference in the rotation direction of the adjustment piece and is interposed between the seat frame and the compression spring.

Namely, the present invention provides a height adjustable chair with rocking function comprises that the compression spring for rocking is interposed between the seat frame which is supported with the leg support extended and contracted by the cylinder internally fitted to and the back frame which is rotatably fitted to the seat frame at the forward end side thereof, wherein the joint part of the joint member having the arm piece protruded on the joint part is rotatably assembled to the seat frame with a vertical shaft, the operation lever whose tip is led to the outside of the seat frame is equipped at one end of the rocking member whose base part is rockably assembled to the joint part with the horizontal shaft, the pressing piece which always positions over the button for rod advancing and retreating of the cylinder and touches and leaves thereof is provided at the other end of the rocking member, and the adjustment piece is rotatably connected to the tip of the arm piece at the tip thereof with the intermediate piece and the base part of the adjustment piece is rotatably fitted to the seat frame, the cam part which interposes between the seat frame and the compression spring and has an upper face having a level difference in the rotation direction of the adjustment piece is provided at the middle portion of the adjustment piece.

Additionally, the present invention comprises that the back frame is fixed to a back frame board, the back frame board is rotatably fitted to the seat frame at the forward end side thereof, a cushion block as the rocking resilient member for supporting the rear end side of the back frame board is assembled to the seat frame, an engaging pin is provided on the tip of the arm piece, a movable plate which is engaged with the engaging pin so as to enable to move forward and backward is provided on the upper face of the seat frame as the regulating member, a protruded part protruding upward is formed on the upper face of the movable plate which is the regulating member, a downwardly protruded part is provided on the under surface of the back frame board wherein the lower end of the downwardly protruded part positions at directly near the upper surface of the protruded part when the movable plate positions at the forward position or backward position.

Namely, the present invention also provides a height adjustable chair with rocking function comprises that the seat frame which is supported with the leg support extended and contracted by the cylinder internally fitted to and the back frame which is rotatably fitted to the seat frame at the forward end side thereof, wherein the back frame is fixed to the back frame board, the back frame board is rotatably fitted to the seat frame at the forward end side thereof, the cushion block as the rocking resilient member for supporting the rear end side of the back frame board is assembled to the seat frame and the resilient member for rocking is interposed between the seat frame and the back frame, wherein the joint part of the joint member having the arm piece protruded on the joint part is rotatably assembled to the seat frame with the vertical shaft, the rocking member whose base part is rockably fitted to the joint part with the horizontal shaft is assembled, and the operation lever whose tip is led to the outside of the seat frame is equipped at one end of the rocking member to make the operation lever rotatable in vertical and lateral directions with the vertical and horizontal shaft.

And, the pressing piece which always positions over the button for rod advancing and retreating of the cylinder and touches and leaves thereof is provided at the other end of the rocking member to enable the extension and contraction of the leg support by vertically moving operation of the operation lever, and the engaging pin is provided on the tip of the arm piece protruded on the joint part, the movable plate which is engaged with the engaging pin so as to enable to move forward and backward is provided on the upper face of the seat frame as the regulating member, the protruded part protruding upward is formed on the upper face of the movable plate which is the regulating member, the downwardly protruded part whose lower end positions at directly near the upper surface of the protruded part when the movable plate positions at the forward position or backward position is provided on the under surface of the back frame board, and then the downward movement of rear side of the downwardly protruded part, that is the back frame, may be limited when the protruded part positions under the downwardly protruded part. Namely, the regulating member which regulates the movement of the back frame according to the rotation of the tip of the arm piece is provided on the upper face of the seat frame. Therefore, the rotation regulation of the back frame is adjustable by moving the movable regulating member according to the laterally moving operation of the operation lever.

According to the present invention described above, when the tip side of the operation lever which is led to the outside of the seat frame is pulled up, the pressing piece at the other end side of the rocking member having the operation lever at its one end side presses (depresses) a button for rod advancing and retreating, and then the rod of the cylinder enable to advance and retreat, the leg support to which the cylinder is internally fitted is extended and contracted, and the height of the seat frame may be adjusted.

In addition, when the rocking member is energized in the rotation direction by the operation lever, the joint member is rotated since the rocking member is assembled to the joint part of the joint member with the horizontal shaft, and the rotation regulation of the back frame to the seat frame enable to adjust by the regulating member which moves according to the movement of the tip of the joint member. Therefore, the present invention may provide a chair which can adjust freely the strength of the rocking and the height of the seat plate (seat frame) by operating one operation lever.

The adjustment piece having the cam part in the middle portion thereof is provided as the regulating member, wherein the adjustment piece is rotatably connected to the tip of the arm piece at the tip thereof with the intermediate piece and is rotatably fitted to the seat frame at the base part thereof. When the cam part has an upper face having a level difference in the rotation direction of the adjustment piece and is interposed between the seat frame and the compression spring, the adjustment piece which is connected to the arm piece of the joint member with the intermediate piece rotates according to the rotation of the joint member, and the strength of the compression spring may be adjusted by the difference of positions of the upper face because the cam part having the level difference in the rotation direction is provided in the middle portion of the adjustment piece. Therefore, the present invention may provide a chair which can adjust freely the strength of the rocking and the height of the seat plate (seat frame) by operating one operation lever.

In addition, the present invention comprises that the movable plate is provided on the upper face of the seat frame as the regulating member and the engaging pin is provided on the tip of the arm piece and is engaged with the movable plate so that the movable plate enable to move forward and backward with the rotation of the tip of the arm piece, the back frame is fixed to the back frame board, the cushion block as the rocking resilient member for supporting the rear end side of the back frame board is assembled to the seat frame, the protruded part protruding upward is formed on the upper face of the movable plate which is the regulating member, and the downwardly protruded part is provided on the under surface of the back frame board wherein the lower end of the downwardly protruded part positions at directly near the upper surface of the protruded part provided on the movable plate when the movable plate positions at the forward position or backward position. Therefore, in case that the protruded part is positioned under the downwardly protruded part by moving the movable plate, the lower end of the downwardly protruded part touches the upper end of the protruded part and the downward movement of the rear side of the back frame is limited when the rear side of the back frame board, that is the rear side of the back frame, moves down, and in case that the protruded part is deviated from the lower position of the downwardly protruded part by moving the movable plate, the rear side of the back frame widely moves down with compressing the cushion block which is the rocking resilient member for supporting the rear end side of the back frame board.

Namely, the present invention may provide a chair, which the switching between the case that the back frame rotates widely with receiving the resilient repulsion of the cushion block by lateral operation of the operation lever and the case that the downwardly protruded part positions over the protruded part so that the rear side of the back frame hardly moves down is handled, and the strength adjustment of rocking and the height adjustment of the seat plate (seat frame) is freely handled by one operation lever with the extension and contraction adjustment of the leg support to which the cylinder is internally fitted by vertically operation of the same operation lever.

BRIEF DESCRIPTION OF THE DRAWINGS

Additionally.

BRIEF DESCRIPTION OF THE PREFERRED EMBODIMENT

Figure 1:
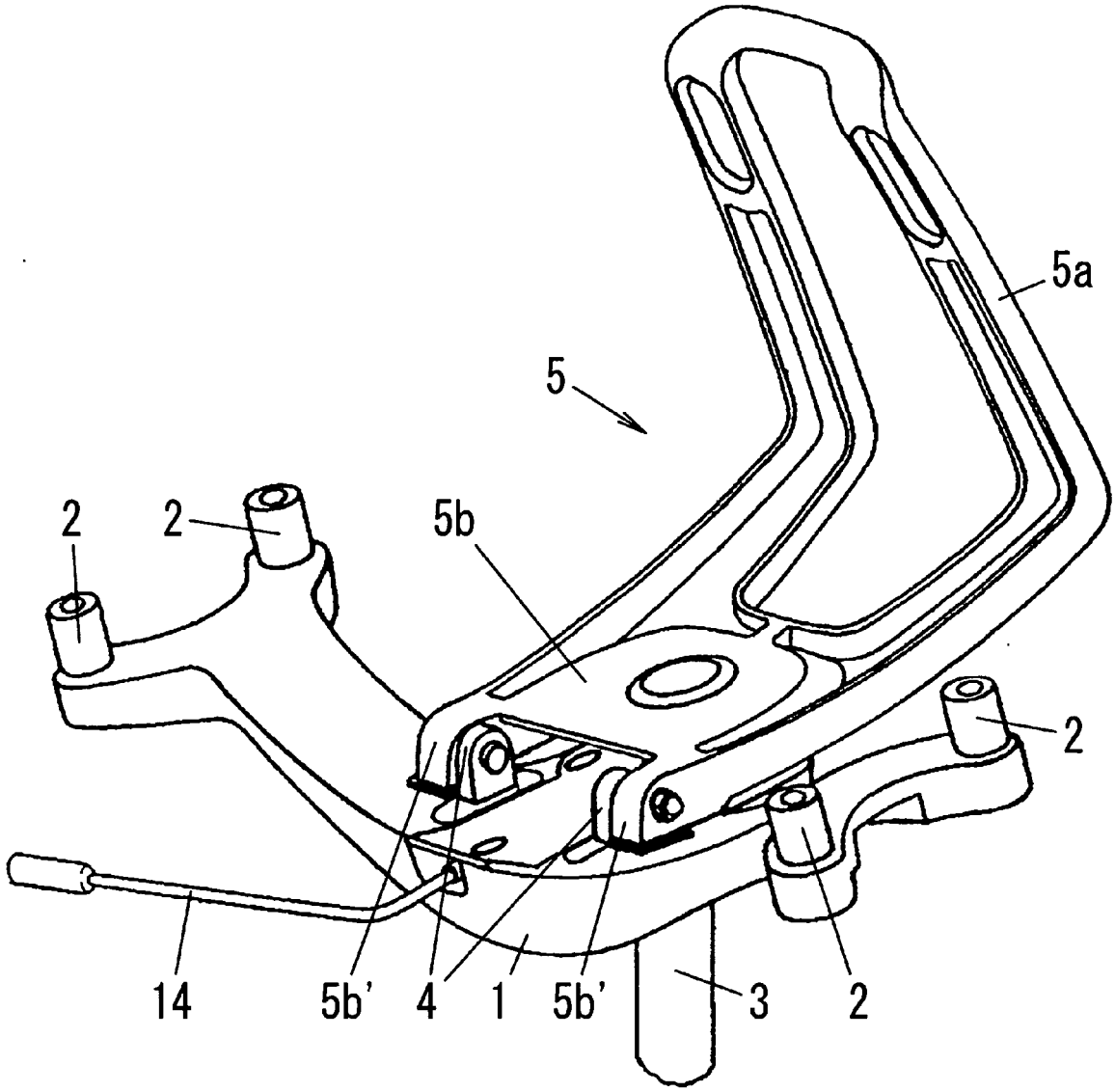
FIG. 1 is a perspective view illustrating the relationship between a seat frame and a back frame.
Figure 2:
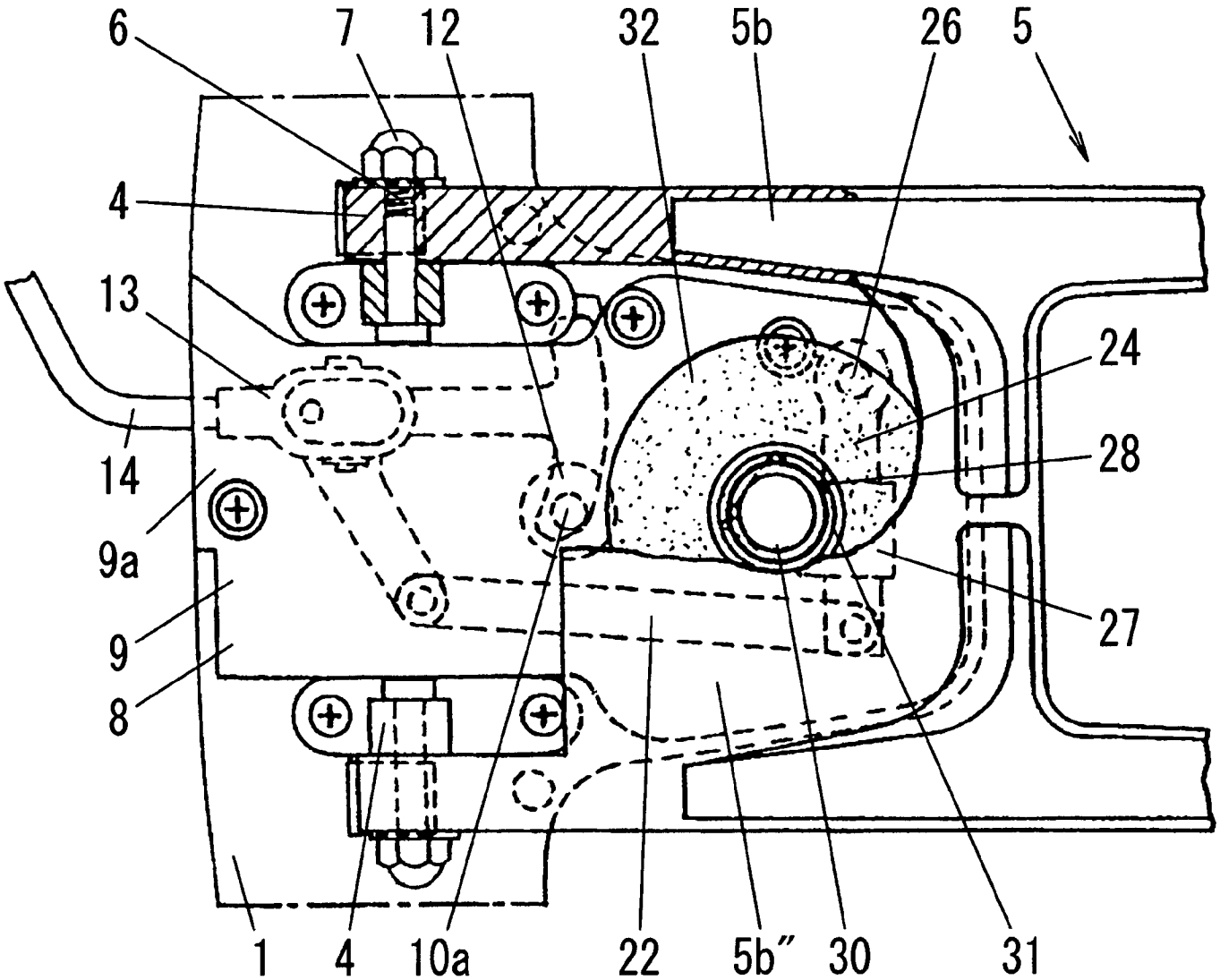
FIG. 2 is a partially broken away plan view illustrating the connection of the seat frame with the back frame.
Figure 3:
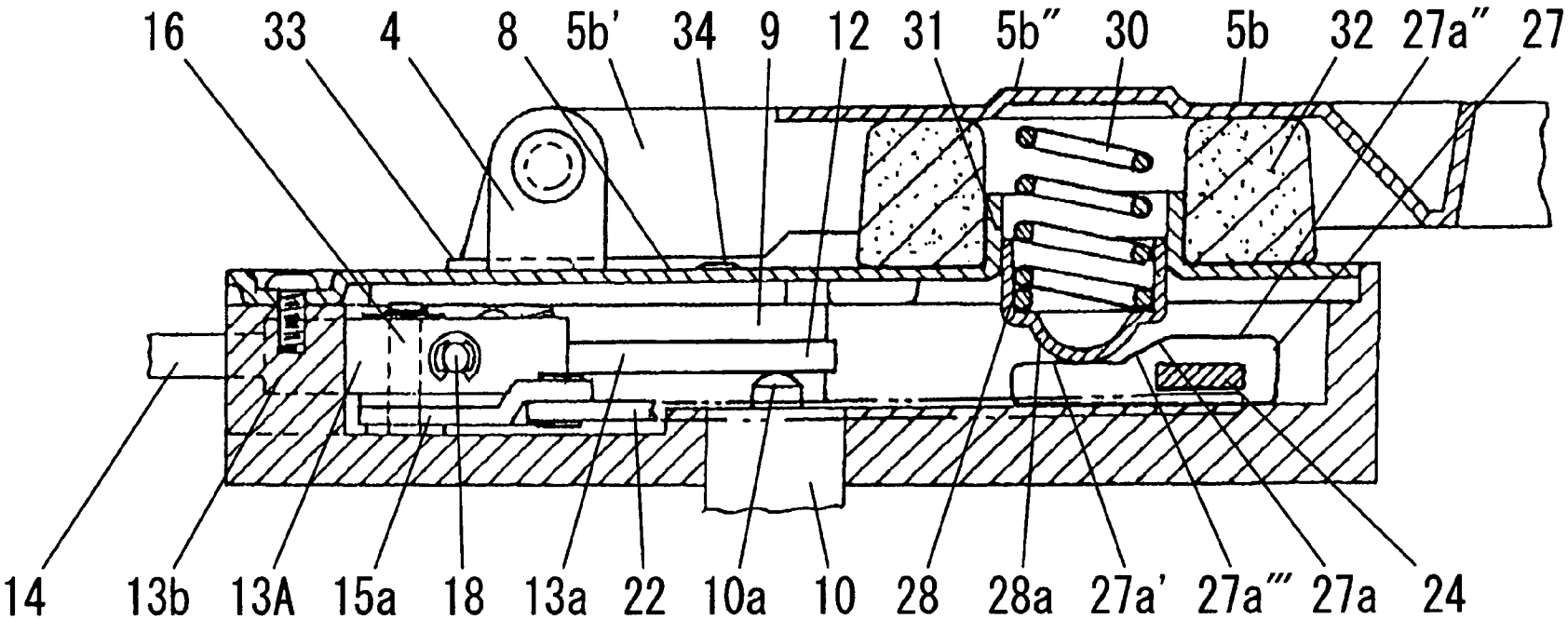
FIG. 3 is a sectional view of principal parts of the invention. And, FIG. 4 is a plan view of FIG. 3 with parts partially skipped.
Figure 4:
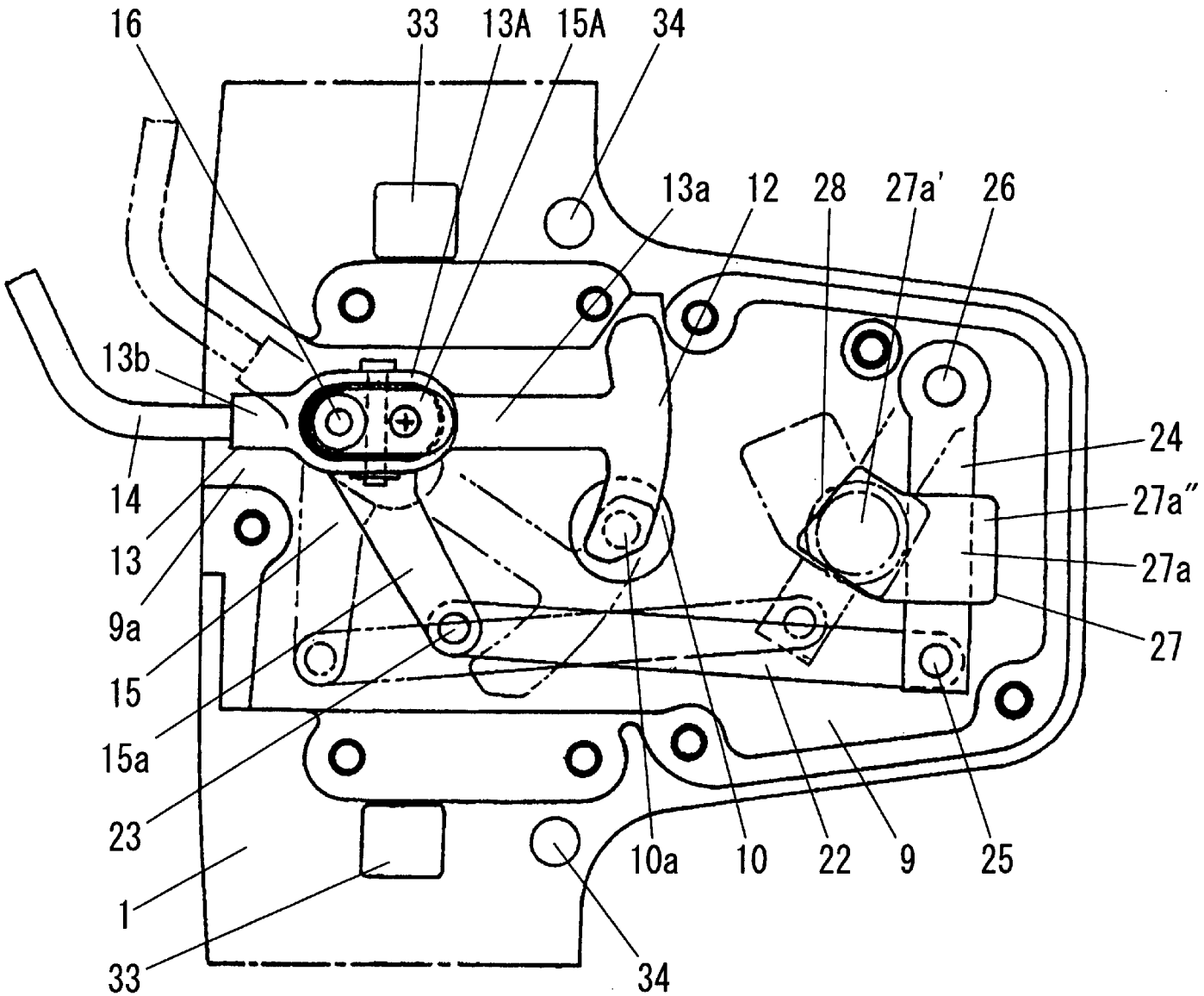
Figure 5:
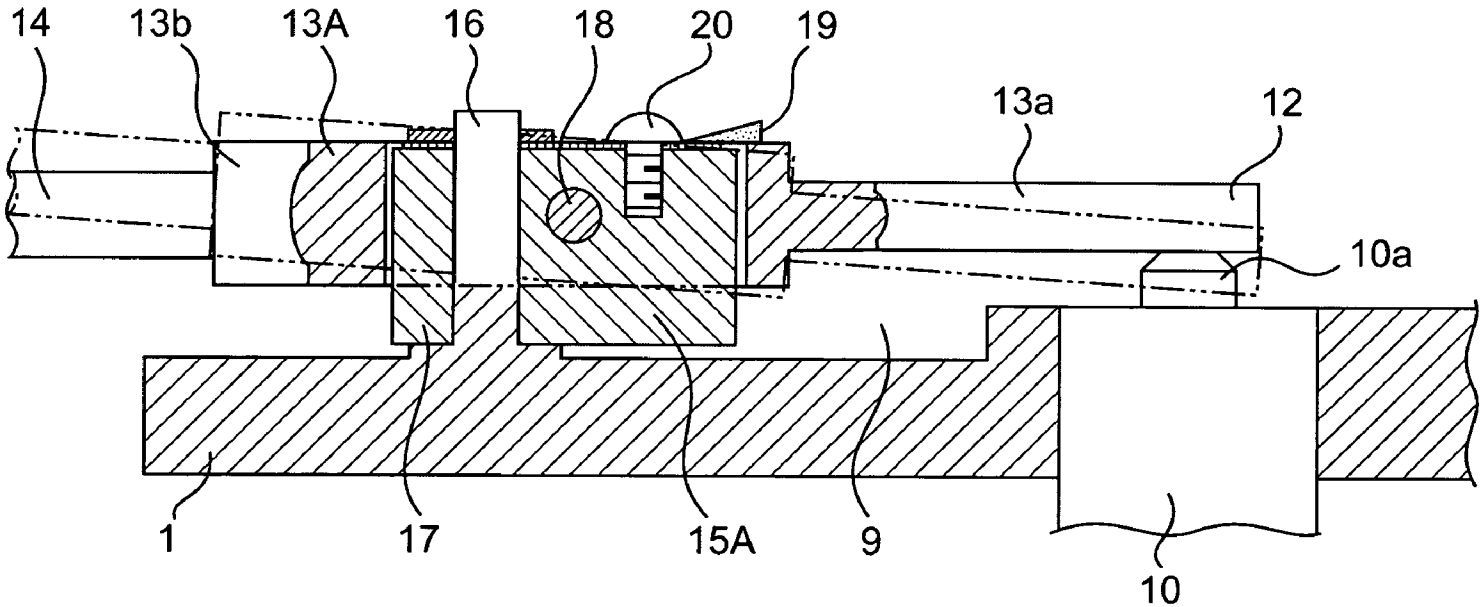
FIG. 5 is an expanded sectional view of a portion of FIG. 3.
Figure 6:
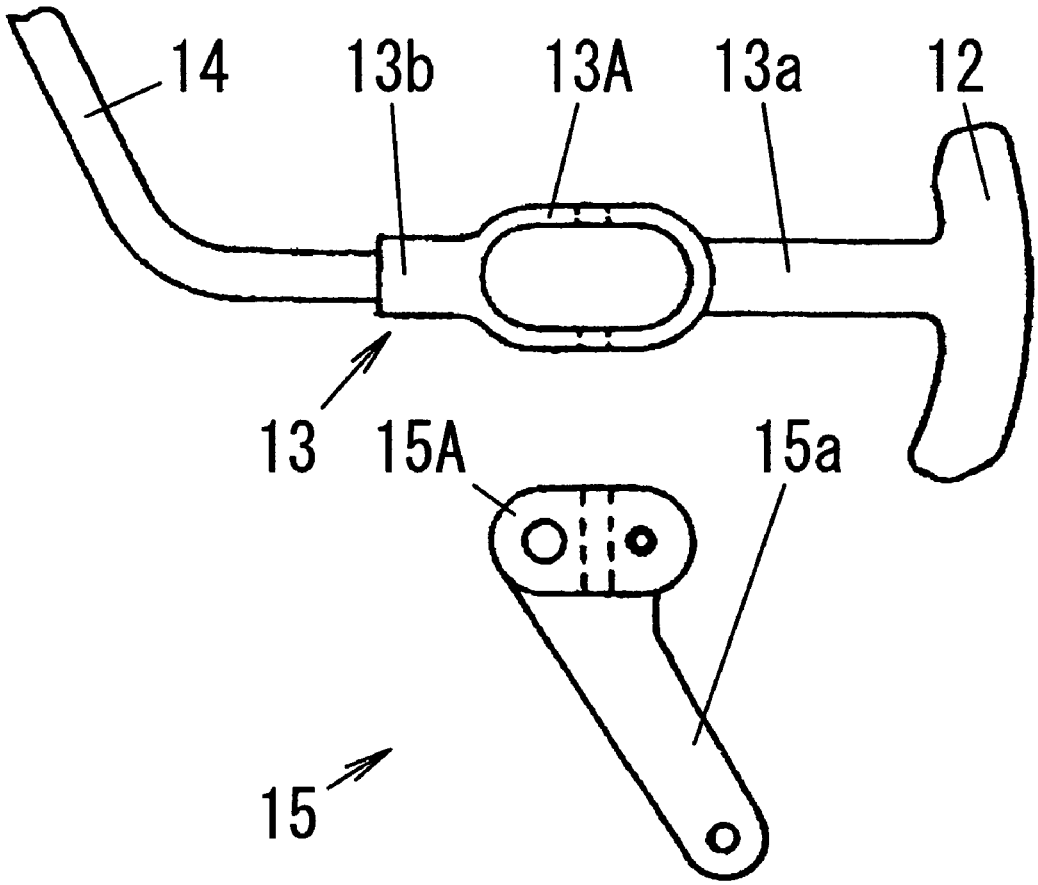
FIG. 6 is an exploded plan view of a lever member and a joint member.

Drawings illustrate an embodiment in a height adjustable chair with rocking function of the present invention. FIG. 1 is a perspective view illustrating the relationship between a seat frame and a back frame; FIG. 2 is a partially broken away plan view illustrating the connection of the seat frame with the back frame; FIG. 3 is a sectional view of principal parts of the invention; FIG. 4 is a plan view of FIG. 3 with parts partially skipped; FIG. 5 is an expanded sectional view of a portion of FIG. 3; and FIG. 6 is an exploded plan view of a lever member and a joint member.

In the drawings, a seat plate (not illustrated) is placed and assembled on cushion members 2,2 which are vertically arranged on both side of a seat frame 1, wherein a rubber is used as the material of cushion members in the embodiment but a coil spring can also be available. While the seat frame 1 is received and supported by a leg support 3, a back frame 5 shaped like a letter L shape in a side view, which is comprised a standing member 5*a* for attaching a back plate (backrest) and a lower member 5*b*, is rotatably fitted to a pair of support part pieces 4, 4 vertically arranged on the upper face of the seat frame at a bifurcated piece 5*b*' of the forward end of the lower member 5*b* with a bolt 6 and a nut 7 screwed to it. Namely, the forward end side of the lower member 5*b* of the back frame 5 is interposed between the seat plate and the seat frame 1.

A recessed part 9, an opened upper surface of which is closed with a lid plate 8 screwed to the seat frame 1, is provided at the upper central part of the seat frame 1, a button 10*a* for rod advancing and retreating operation of a cylinder 10 which is internally fitted to the leg support 3 is retractably protruded at the central part inside of the recessed part 9, and a pressing piece 12 is arranged over the button 10*a*. The height of a chair, that is the height of the seat plate, is adjusted by pressing the button 10*a* into the cylinder 10 with the pressing piece 12.

The pressing piece 12 is an arc shape along a circular arc centering around a base part of a rocking member 13 at one end of the rocking member 13 (rear side of the recessed part 9) whose base part is rockably assembled to the seat frame 1 in front side of the recessed part 9, and the pressing piece 12 positions over the button 10*a* for rod advancing and retreating operation whenever the rocking member 13 rotates with the rotation of a joint member 15 described below. The rocking member 13 having the pressing piece 12 on one end thereof is formed by protruding the pressing piece 12 with a rear connecting piece 13*a* at one end (rear end) of a round ring-shaped base member 13A long in the front and rear direction of the recessed part 9 and by protruding an operation lever 14, which is protruded to outside through a notched part 9*a* of the anterior end of the recessed part 9, with a front connecting piece 13*b* which is an opposite other piece of the rear connecting piece 13*a* at the other end (front end) of the base member 13A, and the ring-shaped base member 13A long in the front and rear direction is rockably assembled to the joint member 15 which is rotatably fitted to a front side of internal the recessed part 9.

The joint member 15 is formed an elliptical joint part 15A in the plan view and an arm price 15*a* protruded at the lower end side of one liner edge portion of the joint part 15A, and is rotatably assembled to the seat frame 1 in a state that a vertical hole 17 provided at the front side of the joint part 15A was externally engaged with a supporting shaft 16 (vertical shaft in claim) erectly provided on the front side of the recessed part 9 of the seat frame 1. The rocking member 13 is rockably assembled in the manner that the base member 13A shaped an elliptical ring shape similar to an ellipse in the plan view of the joint part 15A is loosely fitted from the outside to the joint part 15A of the joint member 15 and a horizontal shaft 18 is penetrated them at the approximately center of the front and rear direction.

Namely, in the rocking member 13, the pressing piece 12 at the rear side of the base member 13A may be vertically rocked (rotated) centering around the horizontal shaft 18 by operating the operation lever 14 protruded at the front side of the base member 13A from the outside of the seat plate, the button 10*a* is pressed and is pressed into the cylinder 10 as described above when the tip of the pressing piece 12 is moved down by operating the operation lever 14.

Additionally, a leaf spring 19 is placed on the joint part 15A of the joint member 15 and is fixed thereto by a screw 20, the pressing piece 12 side of the rocking member 13 is always pressed downward by the leaf spring 19 and touches lightly to the button 10*a* when the button 10*a* protrudes internal the recessed part 9, and the downwardly movement of the pressing piece 12 immediately, without a play, acts on the button 10*a* by operating lever 14 and the pressing piece 12 is pressed down it.

And, one end of an intermediate piece 22 is rotatably fitted to the tip of the arm piece 15*a* of the joint member 15, where the base member 13A of the rocking member 13 is engaged from the outside and is rotatably fitted to the joint part 15A with the horizontal shaft 18, with a first connecting shaft 23, and the other end of the intermediate piece 22 is rotatably fitted to the tip of an adjustment piece 24 with a second connecting shaft 25.

The adjustment piece 24, a regulating member, is rotatably fitted to a shaft 26 at the base part thereof, wherein the shaft 26 is vertically arranged in the rear side of the recessed part 9 of the seat frame 1. A cam part 27, an upper face 27*a* of which is comprised of a lower part 27*a*' and a higher part 27*a*" via a tilting part 27*a*'" so as to line in a rotation direction of the adjustment piece 24, is arranged at the middle portion of the adjustment piece 24, where the upper face 27*a* may be triple-tiered surface though two-tiered surface is shown. And a pressure receiving cylinder 28 to which the upper face 27*a* of the cam part 27 always touches is vertically movably engaged within a guide cylinder 31 which is protruded to the lid plate 8 comprising the seat frame 1.

The pressure receiving cylinder 28 consists of a cylindrical body with bottom, wherein the center of the bottom plate 28*a* thereof is formed into a protruded semicircular shape so as to be a contacting edge of the upper face 27*a*. Thus, the pressure receiving cylinder 28 is in point contact with the upper face 27*a* and the upper face 27*a*, that is the cam part 27, under the pressure receiving cylinder 28 is smoothly moved. And, the pressure receiving cylinder 28 is engaged within the guide cylinder 31 so as to move freely in vertical direction as described above, a compression spring 30 such as a coil spring is interposed between the bottom plate 28*a* and a center piece 5*b*" of a lower member 5*b* of the back frame 5 so that the elasticity of the compression spring 30 works from the under side to the center piece 5*b*" of the lower member 5*b* (back frame 5) and works from the above side to the upper face 27*a* of the cam part 27 via the pressure receiving cylinder 28, a resilient cylindrical supporting member 32 is placed on the lid plate 8 so that the compression spring 30 is surrounded by the guide cylinder 31, and the center part of the lower member 5*b* of the back frame 5 which is rotatably assembled to the supporting piece 4 of the seat frame 1 is supported with the supporting member 32.

And, in the state that the higher part 27*a*' of the cam part 27 is being touched with a bottom plate 28*a* of the pressure receiving cylinder 28, the upper part of the compression spring 30 is placed enough to touch with the center piece 5*b*" of the lower member 5*b*.

This is because that the operation of the operation lever 14 becomes harder because of compressive load from the compression spring 30 and the strength of rocking is not obtained if the compression spring 30 is in compression from the beginning.

Namely, FIG. 3 shows a rocking state by utilizing the resilient force of the cylindrical resilient supporting member 32, and it is a relatively weak rocking state. Moreover, in the state that the higher part 27*a*" of the cam part 27 is being touched with the bottom plate 28*a* of the pressure receiving cylinder 28 by moving the cam part 27, the strongest rocking state can be obtained by the cylindrical resilient supporting member 32 and the compression spring 30 when the weight is kept on the backrest.

The supporting member 32 in the embodiment is comprised of a rubber hollow ring member, but a coil spring may be available and a tire shaped hollow body may also be available. In short, anything which has resilience and is capable of receiving and supporting the middle part of the lower member 5*b* which is a base member (supporting member) of the back frame 5 of which forward end tip side is rotatably supported to the supporting piece 4 may be available.

Additionally, raised parts are each provided in the front side and rear side of the bolt 6 and on the seat frame 1 which is directly below the bifurcated piece 5*b*' of the forward end side of the lower member 5*b* rotatably fitted to the supporting piece 4, wherein the forward raised parts are provided as a front stopper 33 so as to control the forward rotation of the back frame 5 (counterclockwise direction in FIG. 3) centering around the bolt 6 (other bar rod body may be comprisable) by the rapidly energization of the compression spring 30, and the backward raised parts are provided as a rear stopper 34 so that the middle part of the lower member 5*b* touches this and the backward rotation centering around the bolt 6 which is a shaft of the back plate (back frame 5) is controlled so as to prevent the back plate from being too tilted when the weight is loaded on the back plate (not illustrated).

Thus, when the operation lever 14 led to the outside the seat frame 1 (seat plate) through a notched part 9*a* is pulled up, the pressing piece 12 arranged opposite to the operation lever 14 in the rocking member 13 may be rocked (rotated) and moved down centering around the horizontal shaft 18 since the operation lever 14 is protruded at the base member 13A of the rocking member 13 and the base member 13A is assembled to the joint member 15 assembled to the seat frame 1 with the supporting shaft 16.

Accordingly, the button 10*a* located directly below the pressing piece 12 is pressed (depressed) and is pressed into the cylinder 10, and the rod enable to vertically (advancing and retreating) move inside the cylinder 10. The leg support extends and contracts and the seat plate (seat frame 1) moves vertically by reducing the weight of a sitter or loading the weight by adjusting the weight to the seat plate in this state, and when the operation of the operation lever 14 is stopped (when one's hand is released) at the desired position, the seat frame 1, that is the seat plate, may be positioned in the desired position since the press operation of the button 10*a* is released and the expanding and contracting motion of the cylinder 10 is stopped.

When the sitter weights on the back plate in the state that this height position is kept, the supporting member 32 which is an resilient member is reduced in size, the back frame 5 rotates centering around the bolt 6 (in the clockwise direction in FIG. 1) and makes the compression spring 30 reduce in size, the back frame 5 reclines with the limits that it touches the rear stopper 34, and then a rocking effect is obtained.

And, when the operation lever 14 is pressed in the horizontally direction (rotation direction), since the rocking member 13 having the operation lever 14 has been engaged with the joint part 15A of the joint 15 at the base member 13A, an external force from the operation lever 14 side through the base member 13A is loaded to the joint part 15A and the joint part 15A rotates in the pressing direction to the operation lever 14 with centering around the supporting shaft 16 (for example, rotates in the clockwise direction in FIG. 4), the arm piece 15*a* also rotates with the rotation of the joint part 15A, and the adjustment piece 24 as a regulating member, which is connected with an intermediate piece 22 by the first connecting shaft 23 and the second connecting shaft 25, rotates centering around the shaft 26 in accordance with this rotation.

Accordingly, the cam part 27 arranged at the middle portion of the adjustment piece 24, a regulating member, is displaced and moved from the lower part 27*a*' of the upper face 27*a* to the higher part 27*a*" thereof or reversely from the higher part 27*a*" to the lower part 27*a*' so as to position directly below the pressure receiving cylinder 28. The pressure receiving cylinder 28 closes to the back frame 5 side via the compression spring 30 when the cam part 27 is displaced from the lower part 27*a*' to the higher part 27*a*", thus the resilience of the compression spring 30 is increased and the strong rocking is obtained, and the resilience energization of the compression spring 30 becomes weakened just for the difference of the height between the higher part 27*a*" and the lower part 27*a*' when the cam part 27 was displaced from the higher part 27*a*" to the lower part 27*a*', thus the soft rocking is obtained.

The pressing piece 12 which makes the cylinder rod freely vertically move (advance and retreat) by pressing the button 10*a* of the cylinder 10 is an arc shape located over a circular arc centering around the supporting shaft 16, thus in either displacement of the cam part 27 to the position directly below of the pressure receiving cylinder 28 (compression spring 30) from the higher part 27*a*" of the cam upper face 27*a* to the lower part 27*a*' or reversely from the lower part 27*a*' to the higher part 27*a*", the pressing piece 12 is positioned over the button 10*a*, and the height adjustment of the seat plate (seat frame) may be done by the operation described above in each strength case of rocking.

Figure 7:
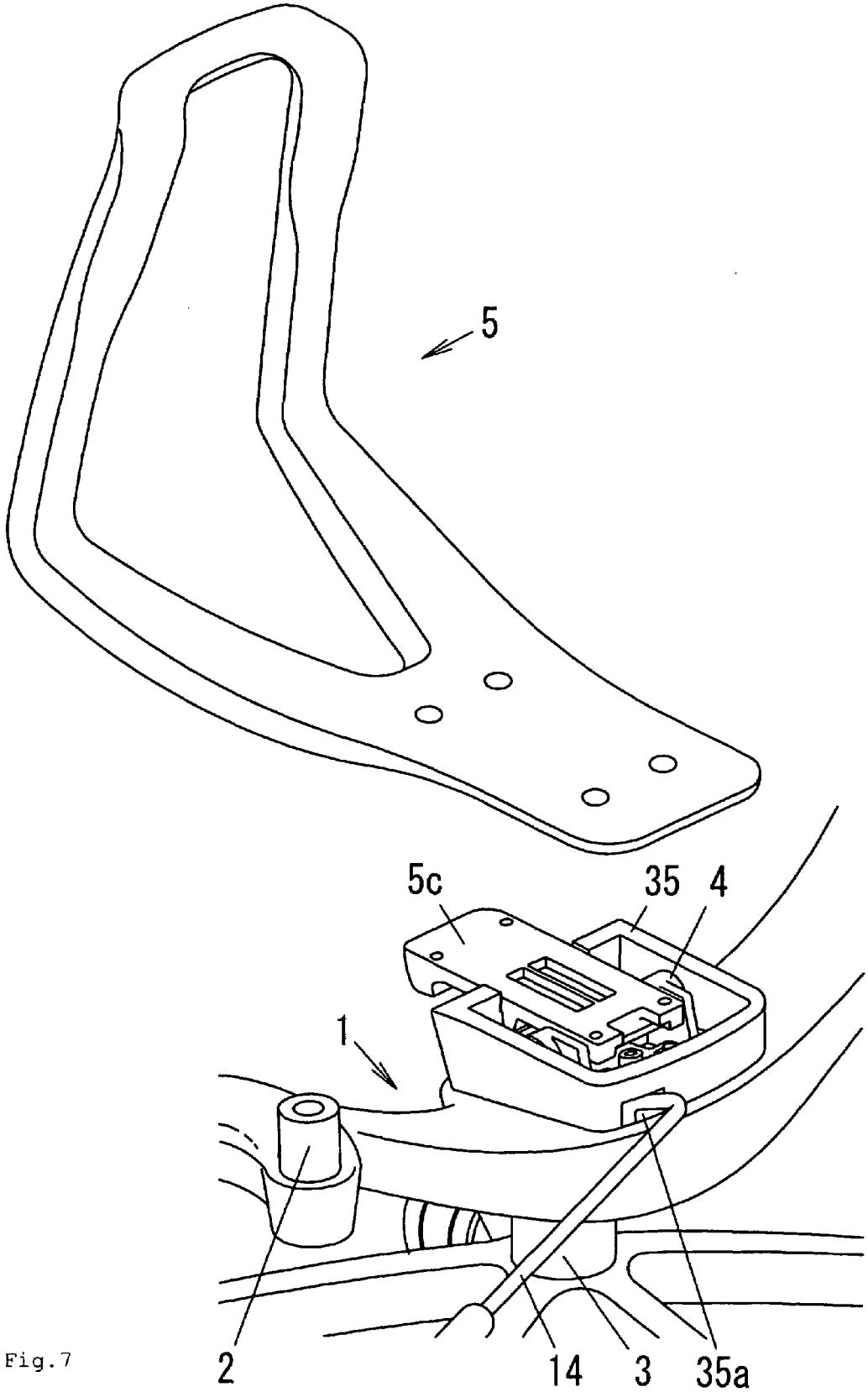
FIG. 7 is a perspective view illustrating the relationship between a seat frame and a back frame of the second embodiment.
Figure 8:
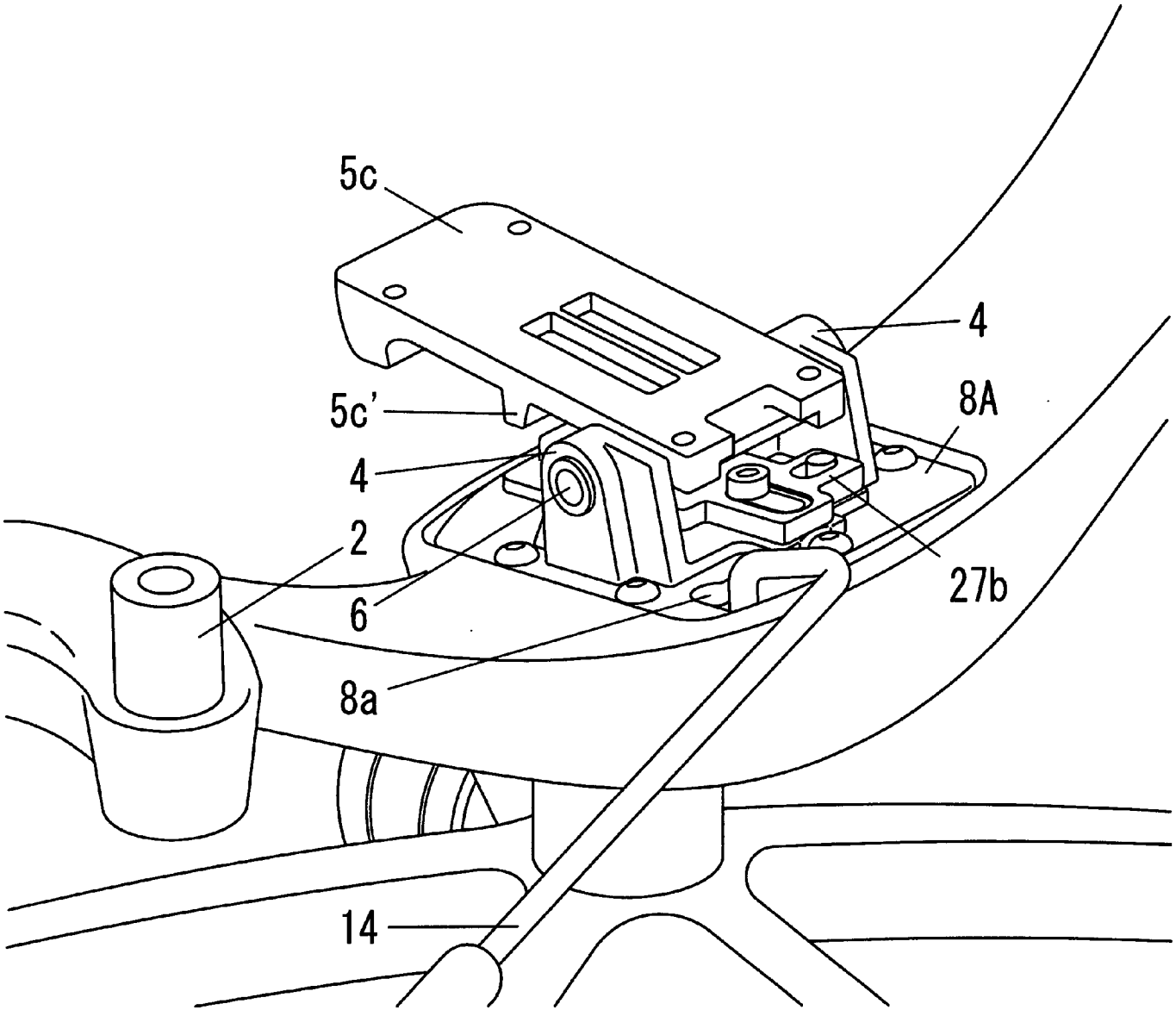
FIG. 8 is a perspective view illustrating the external view of principal parts of the second embodiment.

Additionally, in another embodiment, as shown in FIG. 7, the back frame 5 is fitted to the seat frame 1 with a back frame board 5*c* when it was rotatably fitted to the seat frame 1, and as shown in FIG. 8, the lower part of the near-forward end of the back frame board 5*c* is rotatably fixed to the supporting piece 4 protruded on the upper face of the lid member 8A with the bolt 6 and the nut 7.

Additionally, a cushion block 35, a resilient member, is fixed on the periphery upper part of the lid member 8A, wherein the cushion block 35 is a ringed frame shape surrounding the lid member 8A, the rear part thereof supports the rear end of the back frame board 5*c* so as not to descend below a predefined position, and the upper surface thereof is brought into contact by pressurizing with the undersurface of the back frame board 5*c* and back frame 5 so that the back frame 5 is supported with the front part of the cushion block 35 so as not the front end thereof to excessively fall.

Figure 11:
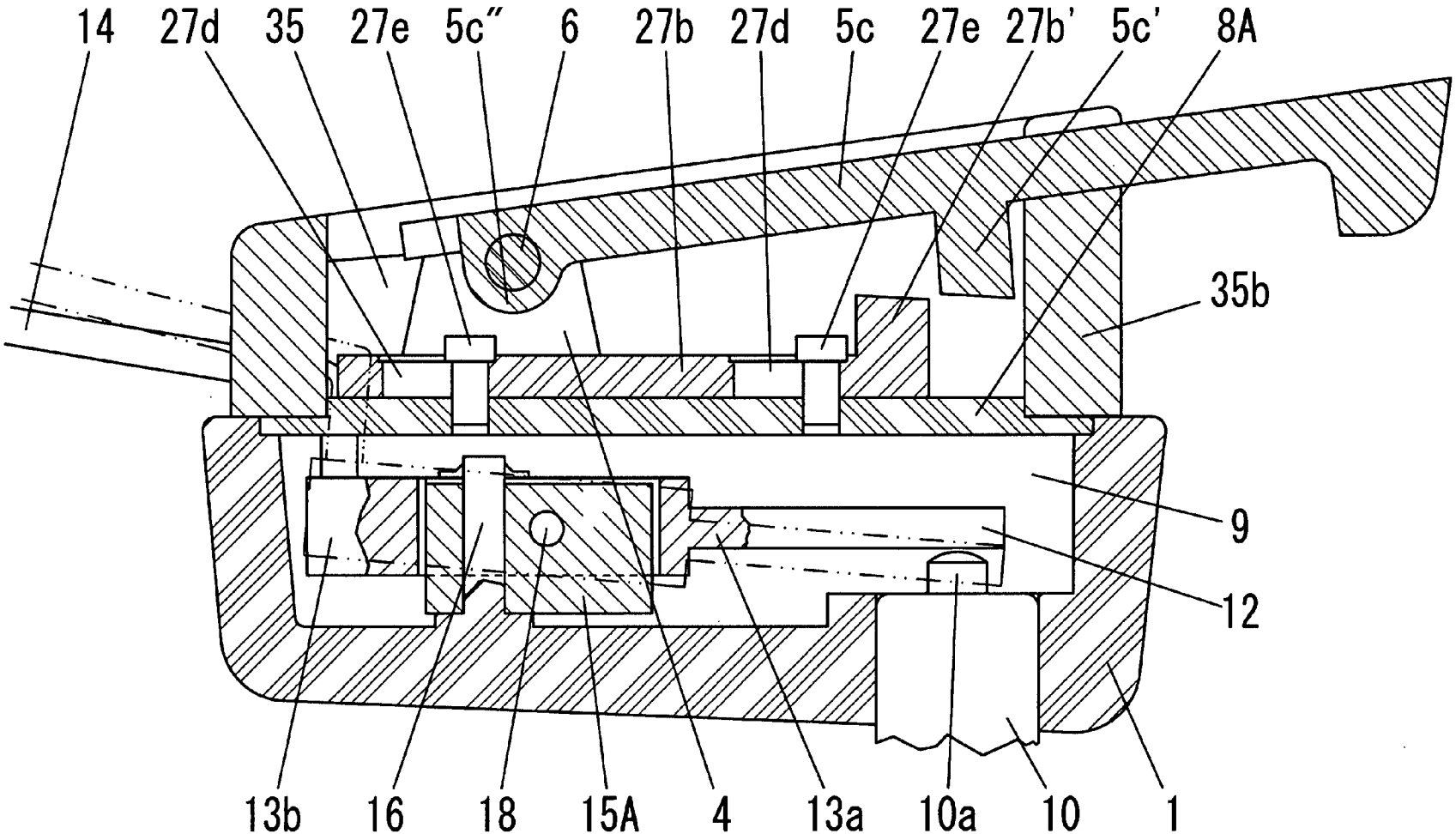
FIG. 11 is a sectional view of principal parts of the second embodiment.

As shown in FIG. 8 and FIG. 11, the lid member 8A covers the recessed part 9 formed in the seat frame 1, it has a notch 8*a* for protruding the operation lever 14 and is fixed to the seat frame 1 with a screw.

Figure 10:
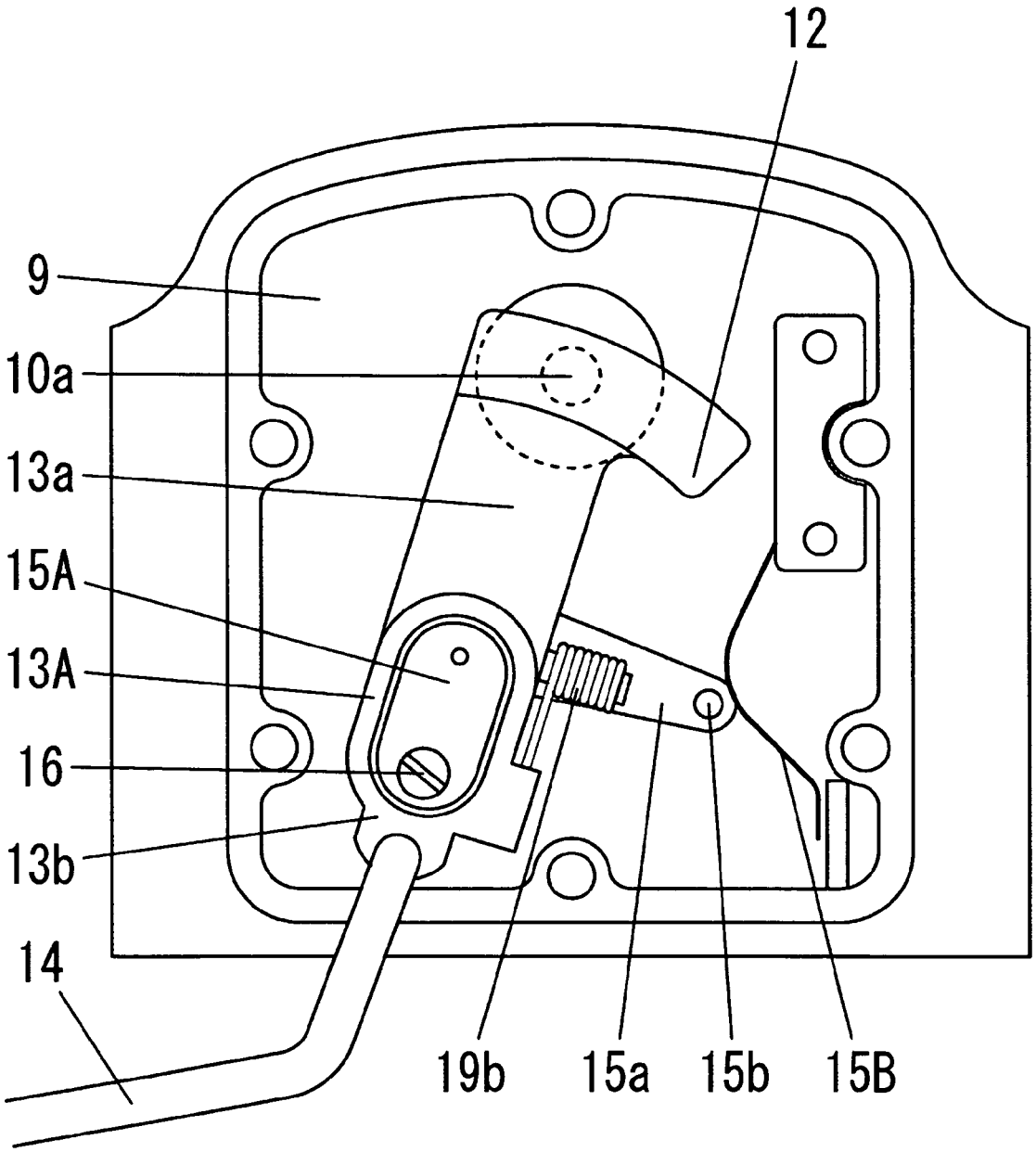

As shown in FIG. 10, the pressing piece 12, the rocking member 13, the joint member 15 and others are installed in the recessed part 9 formed in the frame 1 as well as the embodiment described above. In the front side of the recessed part 9, the joint part 15A of the joint member 15, the base part of which is rockable in laterally direction centering around the supporting shaft 16, is assembled to the seat frame 1, the pressing piece 12 which is an arc shape along a circular arc centering around the base part is provided at the rear connecting piece 13*a* of the rocking member 13 fitted to the joint part 15A, and the pressing piece 12 always positions over the button 10*a* for rod advancing and retreating operation whenever the rocking member 13 rotates with the rotation of the joint member 15.

The rocking member 13 having the pressing piece 12 on one end thereof is formed by protruding the pressing piece 12 with the rear connecting piece 13*a* at one end (rear end) of the round ring-shaped base member 13A long in the front and rear direction of the recessed part 9 and by protruding the operation lever 14, which is protruded to outside through the notch 8*a* of the lid member 8A and a recessed notch part 35*a* of the cushion block 35, with the front connecting piece 13*b* which is an opposite other piece of the rear connecting piece 13*a* at other end (front end) of the base member 13A, and the ring-shaped base member 13A long in the front and rear direction is rockably assembled to the joint member 15 which is rotatably fitted to a front side of internal the recessed part 9, as well as the embodiment described above.

The joint member 15 is formed an elliptical joint part 15A in the plan view and an arm price 15*a* protruded at the lower end side of one liner edge portion of the joint part 15A, and is rotatably assembled to the seat frame 1 in a state that a vertical hole provided at the front side of the joint part 15A was externally engaged with a supporting shaft 16 erectly provided on the front side of the recessed part 9 of the seat frame 1. The rocking member 13 is rockably assembled in the manner that the base member 13A shaped an elliptical ring shape similar to an ellipse in the plan view of the joint part 15A is loosely fitted from the outside to the joint part 15A of the joint member 15 and a horizontal shaft 18 is penetrated them at the approximately center of the front and rear direction.

Therefore, as shown in FIG. 11, in the rocking member 13, the pressing piece 12 at the rear side of the base member 13A may be vertically rocked (rotated) centering around the horizontal shaft 18 by operating the operation lever 14 protruded at the front side of the base member 13A from the outside of the seat plate, the button 10*a* is pressed and is pressed into the cylinder 10 as described above when the tip of the pressing piece 12 is moved down by operating the operation lever 14.

The button 10*a* for rod advancing and retreating operation of a cylinder 10 internally fitted to the leg support 3 is retractably protruded at the near-rear end inside of the recessed part 9 of the seat frame 1, and a pressing piece 12 is arranged over the button 10*a*. The height of a chair, that is the height of the seat plate, is adjusted by pressing the button 10*a* into the cylinder 10 with the pressing piece 12.

An energizing spring 19*b* is fitted to a spring shaft provided at the side of the base member 13A of the rocking member 13, wherein one end thereof is engaged with the side of the front connecting piece 13*b* of the rocking member 13 and other end thereof is brought into contact by pressurizing with the upper surface of the arm piece 15*a* of the joint member 15. The pressing piece 12 side of the rocking member 13 is always pressed downward by the energizing spring 19*b* and touches lightly to the button 10*a* of cylinder, which is protruded internal the recessed part 9, and immediately, without a play, acts on the button 10*a* and pressed down this when the pressing piece 12 moves down by operating with the operation lever 14.

Additionally, a leaf spring is touchably arranged at the tip of the arm piece 15*a* as a regulating spring 15B, the middle part of the leaf spring as the regulating spring 15B is protruded in the direction of the vertical shaft to which the joint member 15 is fixed so that the regulating spring 15B touches the rear-lateral side of the tip of the arm piece 15*a* when the tip of the arm piece 15*a* rotates to the front position and touches the front-lateral side of the tip of the arm piece 15*a* when the tip of the arm piece 15*a* rotates to the rear position.

Therefore, the tip of the arm piece 15*a* may be stabilized by the regulating spring 15B at the only two positions of the front and rear position.

Also, the engaging pin 15*b* which penetrates the lid member 8A and protrudes on the upper face of the lid member 8A is provided at the tip of the arm piece 15*a* protruded from the joint part 15A of the joint member 15, and a movable plate 27*b* which engages with the engaging pin 15*b*, a regulating member, is provided on the upper face of the lid member 8A.

Figure 9:
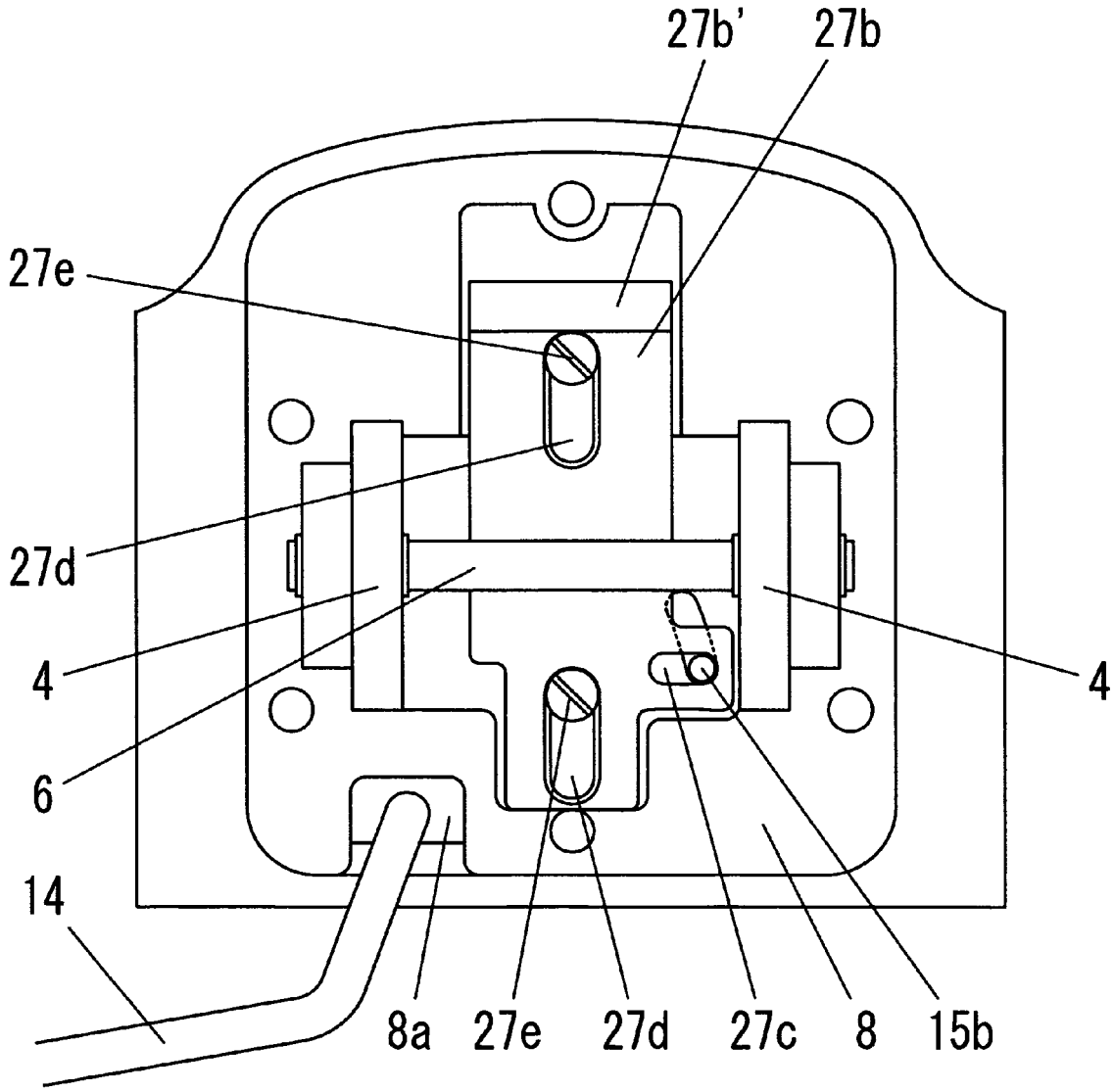
FIG. 9 is a view illustrating the upper surface of the seat frame of the second embodiment. And, FIG. 10 is a plan view of principal parts of the second embodiment.

As shown in FIG. 9, the movable plate 27*b* has a protruded part 27*b*' protruded upward on the upper face of the rear end of the thick planer shaped main body thereof, and the main body thereof has elongate openings 27*d* long in the front and rear direction and an engaging opening 27*c* in which the top end of the engaging pin 15*b* provided at the arm piece 15*a* is inserted.

The engaging opening 27*c* is an elongated shape, the inner diameter of which is substantially same size of diameter of the engaging pin 15*b* in the front and rear direction of the movable plate 27*b* and is longer size of diameter of the engaging pin 15*b* in the laterally direction of the movable plate 27*b*.

The movable plate 27*b* is assembled on the upper face of the lid member 8A to be movable in the front and rear direction by the fixing screws 27*e* inserted in the elongate openings 27*d* long in the front and rear direction.

The back frame board 5*c* is, as shown in FIG. 11, rotatably fixed to the supporting piece 4 provided on the lid member 8A with the bolt 6 which penetrates the supported piece 5*c*" providing on the undersurface of the near-front end of the back frame board 5*c*, and the rear end of the back frame board 5*c* is protruded backward from the cushion block 35 and the near-rear end of the back frame board 5*c* is supported by the cushion block 35.

And, a downwardly protruded part 5*c*' protruding downward is provided on the substantially center undersurface of the back frame board 5*c*, the lower end of the downwardly protruded part 5*c*' is positioned at a slightly higher position from the upper end of the protruded part 27*b*' provided on the rear end of the movable plate 27*b* when the back frame board 5*c* is supported by the cushion block 35.

Additionally, the downwardly protruded part 5*c*' is formed in a position that the downwardly protruded part 5*c*' positions over the protruded part 27*b*' when the movable plate 27*b* is moved backward along the elongate opening 27*d*, and a thickness in a front and rear direction of the downwardly protruded part 5*c*' and protruded part 27*b*' is determined so that the downwardly protruded part 5*c*' is deviated from the upper of the protruded part 27*b*' when the movable plate 27*b* is moved forward along the elongate opening 27*d*.

Therefore, when the operation lever 14 is moved in the laterally direction, for example, when the tip of the operation lever 14 is moved in the left direction, the arm piece 15*a* rotates centering around the vertical shaft so that the tip thereof is moved in the rear direction, the engaging pin 15*b* rotates in the rear direction, and the movable plate 27*b* moves backward with the rotation of the engaging pin 15*b*.

Therefore, the protruded part 27*b*' provided at the rear end of the movable plate 27*b* is positioned under the downwardly protruded part 5*c*', the back frame board 5*c* and thus the back frame 5 rotates so that the rear side of the back frame board 5*c* may move down just a slight interspace of the lower end of the downwardly protruded part 5*c*' to the upper end of the protruded part 27*b*'.

Moreover, when the tip of the operation lever 14 was moved in the right direction and subsequently the movable plate was moved forward, the lower end of the downwardly protruded part 5*c*' may be moved down below the upper end position of the protruded part 27*b*' because the protruded part 27*b*' is deviated from the under position of the downwardly protruded part 5*c*', thus the rear side of the back frame board 5*c* is widely moved down with the cushion block 35 which supports the undersurface of the seat frame board 5*c* is pressed.

The cushion block 35, the upper surface of which is slightly higher than the back frame board 5*c*, is fixed to the seat frame 1 along the periphery part of the lid member 8A and is compressed between the seat frame 1 and back frame 5, wherein a recessed notch part 35*a* for protruding the operation lever 14 is provided in front part so as to fit the position of the notch 8*a* of the lid member 8A, and the rear part of the cushion block 35, which is located below the back frame board 5*c*, has a desired width in the front and rear direction as a board receiving part 35*b* and the cushioning of rocking the back frame 5 is obtained by the board receiving part 35*b* and the cushion block 35 near the board receiving part 35*b*.

Therefore, in the case that the protruded part 27*b*' was positioned under the downwardly protruded part 5*c*' or not, the scope of reclining of the back frame 5, namely the back plate, may be changed with being resiliently supported by the cushion block 35.

Not only the cushion block 35 is formed along the periphery part of the lid member 8A as a ringed frame shape, but it also is formed below the rear position of the back frame board 5*c* as the board receiving part 35*b* which at least supports the rear side of the back frame board 5*c*.

In addition, drawings show the embodiment that there is a slightly interspace between the upper end of the protruded part 27*b*' and the lower end of the downwardly protruded part 5*c*' in state that whole of the cushion block 35 was slightly compressed by the under face of the back frame 5 and the back frame board 5*c*, but it may be available that the height of the upper end of the protruded part 27*b*' is same as the height of the lower end of the downwardly protruded part 5*c*' and a tilting part is formed on the upper rear edge of the protruded part 27*b*' so as to enable to certainly insert under the downwardly protruded part 5*c*'.

In this case, the backward reclining of the back plate is blocked with keeping the back plate and the back frame 5 fixed when the protruded part 27*b*' was positioned under the downwardly protruded part 5*c*', and the back plate enable to rock when the protruded part 27*b*' was deviated from the under position of the downwardly protruded part 5*c*'.

In these embodiment, the protruded part 27*b*' is formed on the rear end upper face of the movable 27*b* so that the protruded part 27*b*' is deviated from the under position of the downwardly protruded part 5*c*' when the movable plate 27*b* was moved forward, but it is available that the protruded part 27*b*' is positioned under the downwardly protruded part 5*c*' when the movable plate 27*b* was moved forward and is deviated from the under position of the downwardly protruded part 5*c*' when the movable plate 27*b* was moved backward, and it is also available that not only the protruded part 27*b*' is formed on the rear end of the movable plate 27*b* but it also is formed on the middle upper face of the movable plate 27*b*.

Additionally, the protruded part 27*b*' shown in FIG. 11 is formed as one step shape protruded from the upper face of the main body of the movable plate 27*b*, but the protruded part 27*b*' having several steps which is a tiered shape comprising flat surfaces having a width matched with the longitudinal width of the downwardly protruded part 5*c*' may be available.

In this case, several recesses are provided on the movable plate 27*b* and others so that each steps formed at the protruded part can temporarily stop the movable plate 27*b* at the under position of the downwardly protruded part 5*c*', and a click feeling is obtained at the stopping position of the each step by a regulating spring and others.

In addition, a gas cylinder is used for the cylinder 10 in the embodiment, any one of an air cylinder and a hydraulic pressure cylinder and others may be available.

The present invention may provide a height adjustable chair with rocking function which an operation portion for adjusting the strength of the rocking movement and an operation portion of the cylinder for lifting and lowering a seat plate (extending and contracting a leg support) were constructed as the same operation portion.

What is claimed is:

1. A height adjustable chair with rocking function comprising: a seat frame which is supported with a leg support extended and contracted by a cylinder internally fitted to, a back frame which is rotatably fitted to the seat frame at the forward end side thereof, and an resilient member for rocking which is interposed between the seat frame and the back frame;

wherein a joint part of a joint member having an arm piece protruded on the joint part is rotatably assembled to the seat frame with a vertical shaft;

wherein a rocking member whose base part is rockably fitted to the joint part with a horizontal shaft is assembled, wherein an operation lever whose tip is led to the outside of the seat frame is equipped at one end of the rocking member to make the operation lever rotatable in vertical and lateral directions with the vertical and horizontal shaft and a pressing piece which always positions over a button for rod advancing and retreating of the cylinder and touches and leaves thereof is provided at the other end of the rocking member to enable the extension and contraction of the leg support by vertically moving operation of the operation lever;

wherein a regulating member which moves according to the rotation of the tip of the arm piece is provided in the seat frame, whereby the regulating member enable to move by the laterally moving operation of the operation lever and the rotation control of the back frame is adjustable by moving the regulating member; and wherein the back frame is fixed to a back frame board, the back frame board is rotatably fitted to the seat frame at the forward end side thereof, a cushion block as the rocking resilient member for supporting the rear end side of the back frame board is assembled to the seat frame, an engaging pin is provided on the tip of the arm piece, a movable plate which is engaged with the engaging pin so as to enable to move forward and backward is provided on the upper face of the seat frame as the regulating member, a protruded part protruding upward is formed on the upper face of the movable plate which is the regulating member, a downwardly protruded part whose lower end positions at directly near the upper surface of the protruded part when the movable plate positions at the forward position or backward position is provided on the under surface of the back frame board.

2. The height adjustable chair with rocking function of claim 1, wherein a compression spring as the resilient member is interposed between the seat frame and the back frame; and wherein an adjustment piece having a cam part in the middle portion thereof is provided as the regulating member, wherein the adjustment piece is rotatably connected to the tip of the arm piece at the tip thereof with an intermediate piece and is rotatably fitted to the seat frame at the base part thereof to make the cam part provided at the adjustment piece movable according to the rotation of the arm piece, and the cam part provided at the middle portion of the adjustment piece has an upper face having a level difference in the rotation direction of the adjustment piece and is interposed between the seat frame and the compression spring.

* * * * *